United States Patent [19]

Stahl

[11] 4,111,603

[45] Sep. 5, 1978

[54] CERAMIC ROTOR BLADE ASSEMBLY FOR A GAS TURBINE ENGINE

[75] Inventor: William F. Stahl, Middletown Township, Delaware County, Pa.

[73] Assignee: Westinghouse Electric Corp., Pittsburgh, Pa.

[21] Appl. No.: 686,860

[22] Filed: May 17, 1976

[51] Int. Cl.[2] ..... F01D 5/18

[52] U.S. Cl. ..... 416/95; 416/219 R; 416/241 B; 416/248; 416/193 A

[58] Field of Search ..... 416/241 B, 193 A, 219, 416/220, 95, 248

[56] References Cited

U.S. PATENT DOCUMENTS

| | | | |
|---|---|---|---|
| 1,554,614 | 9/1925 | Allen | 416/193 X |
| 2,686,655 | 8/1954 | Schörner | 416/241 B X |
| 2,873,947 | 2/1959 | Perry | 416/241 B X |
| 3,002,675 | 10/1961 | Howell et al. | 416/193 X |
| 3,266,770 | 8/1966 | Harlow | 416/193 A X |
| 3,266,771 | 8/1966 | Morley | 416/193 A X |
| 3,295,825 | 1/1967 | Hall | 416/193 A X |
| 3,490,852 | 1/1970 | Carlstrom et al. | 416/220 X |
| 3,702,222 | 11/1972 | Bernales | 416/193 A X |
| 3,834,831 | 9/1974 | Mitchell | 416/193 A X |
| 3,867,069 | 2/1975 | Bussell | 416/193 A X |
| 3,897,171 | 7/1975 | Stahl | 416/241 B X |
| 4,032,258 | 6/1977 | Snell | 416/244 A X |

FOREIGN PATENT DOCUMENTS

| | | | |
|---|---|---|---|
| 671,512 | 12/1929 | France | 416/193 |

*Primary Examiner*—Everette A. Powell, Jr.
*Attorney, Agent, or Firm*—F. A. Winans

[57] ABSTRACT

The present invention provides an assembly for mounting a row of ceramic rotor blades in the metal rotor disc of a gas turbine engine. The major components of the assembly comprise a well known ferritic metal rotor disc in which is mounted, in a conventional fir-tree root configuration, a plurality of high temperature metal alloy or super alloy intermediate members forming an annular array thereof and defining "dog-bone" shaped axial grooves in the annular face for receipt of a complementary "dog-bone" or single serration root of a ceramic blade for mounting an annular array of ceramic blades. The root shank portion and the air foil portion of the blade are separated by a platform and centrifugal-force pins are inserted between adjacent platforms to fix the blade against low frequency vibration and to seal the gap therebetween against leakage of the motive fluid into the root area. The rotor disc is cooled and radial passages are provided in the intermediate members to permit cooling flow therethrough to maintain the temperature gradient through the assembly.

5 Claims, 2 Drawing Figures

CERAMIC ROTOR BLADE ASSEMBLY FOR A GAS TURBINE ENGINE

BACKGROUND OF THE INVENTION

The invention relates to an assembly of blades to the disc of a gas turbine engine rotor and more particularly to such an assembly employing ceramic blades for high temperature inlet conditions to the turbine and assembled to a generally low temperature ferritic alloy disc.

It is well known that the efficiency of a gas turbine engine can be increased by increasing the inlet temperature of the motive fluid. However, it is also well known that the temperatures of the turbine parts must be maintained in a range wherein such parts do not lose their strength or become easily attacked by the corrosive nature of the motive fluid.

High density, hot pressed silicon nitride, silicon carbide and other ceramic materials have the ability to withstand relatively high temperatures without loss of strength or incurring corrosive deterioration. Because such material is rather brittle and susceptible to failure under tensile stress (and thereby sensitive to stress concentrating notches) its use for rotating blades subjected to high centrifugal and bending forces in large gas turbine engines has not met with much success. However, see U.S. Pat. No. 3,943,703 as an example of a small gas turbine engine with certain ceramic components including the rotating blades, to increase the permissible temperature of the operation cycle.

Thus, for the most part, the turbine inlet temperatures have been limited to the range dictated by the high temperature super metal alloys which generally maintain their strength up to approximately 1600°-1700° F, whereas with ceramic blades it would be possible to increase the inlet temperature to 2300°-2500° F with a significant increase in turbine efficiency.

Also, because the high temperature metal alloys are rather expensive it is common to use such metal for the blades only and use a lesser expensive ferritic or low alloy metal rotor and integral disc in the gas turbine and cool the disc to the temperature of 600°-800° F to maintain it within an acceptable temperature range.

SUMMARY OF THE INVENTION

The present invention provides an assembly for mounting ceramic rotor blades in a metal rotor disc such that the tensile stress in the ceramic blades is within a range which the ceramic can withstand while notch sensitivity of the blade root configuration is minimized and the temperatures of the metal disc and rotor are maintained within an acceptable range even though the inlet temperature of the motive fluid is 2300°-2500° F.

In the preferred embodiment, an annular array of radially extending intermediate members composed of a high temperature metal alloy are mounted in the ferritic metal disc in a conventional fir-tree root configuration having multiple serrations which, because of the ductility of the metal, distributes the centrifugal force over a large area. The annular array of intermediate members defines an outer peripheral surface, with the circumferential gap between any two adjacent members defining a "dog-bone" shaped groove for receipt of the single serration or "dog-bone" shaped root of a ceramic blade, which configuration reduces stress concentrating notches in the ceramic blade. The blade comprises an airfoil portion disposed in the path of the motive fluid and therefore generally having a temperature of 2300°-2500° F, and the root portion which includes a shank portion extending to the enlarged rounded inner end engaging the intermediate members. The airfoil portion and shank portion are separated by a blade platform, which, on adjacent blades, extends arcuately toward one another. A centrifugal force pin, also of ceramic, is disposed in a groove formed by complementary wedge-shaped surfaces radially inwardly of the adjacent platforms. During rotation, the pin is wedged into the gap between adjacent blade platforms to provide a seal thereat so that the motive fluid does not leak to the intermediate members. Also the wedging action generally fixes each blade against low frequency vibration.

Each intermediate connecting member provides a radially extending passageway for directing cooling fluid from the rotor to generally adjacent the root of the blade. The cooling fluid removes heat that would otherwise, over an extended period of time, permit the temperatures to equalize, and thus maintains a temperature gradient such that the temperature of the rotor disc is approximately 600° F and the temperature of the intermediate member at its interface with the ceramic blade is approximately 1500° F, both temperatures thus being well within their accepted operating range.

DESCRIPTION OF THE PREFERRED EMBODIMENT

Figure 1:
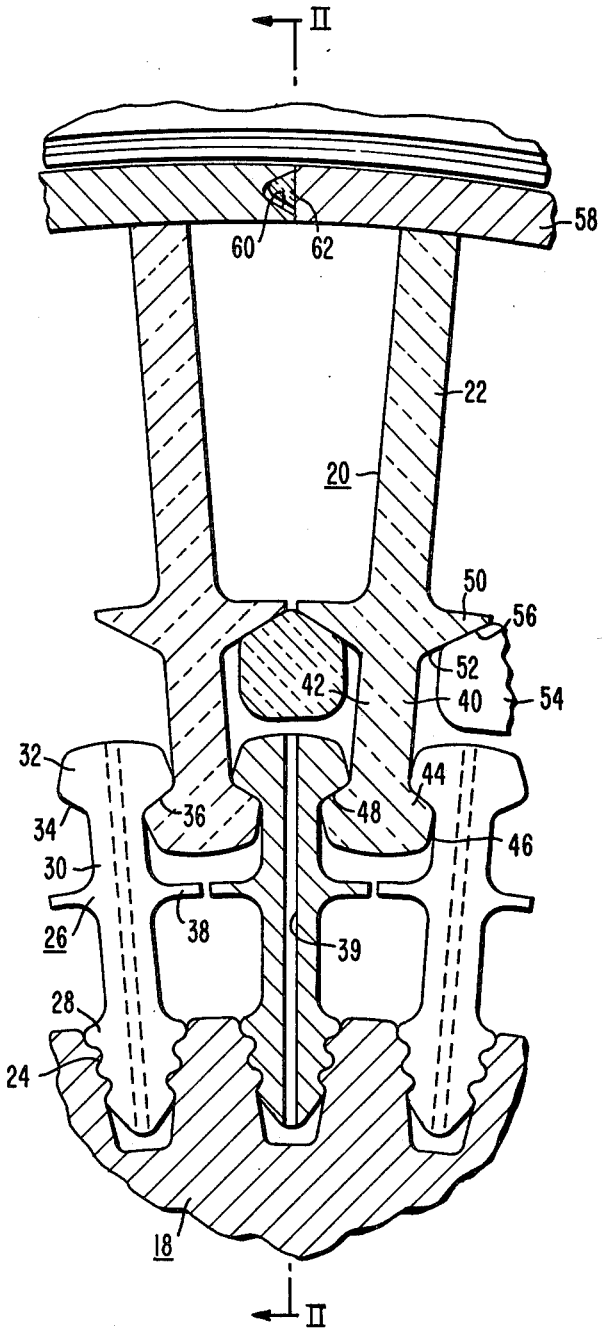
FIG. 1 is a partial corss-sectional elevational view along the axial extent of one stage of a gas turbine engine; and, FIG. 2 is a view generally along line II—II of FIG. 1.

Referring to FIG. 1, a portion of a gas turbine engine 10 is shown having a motive fluid flow path defined by an outer shroud 12 attached to a casing (not shown) and an inner shroud 14 attached to the outer shroud as through stationary nozzle vanes 16. A rotor disc 18 which forms an integral part of the axially extending rotor (not shown) is interposed between adjacent annular rows of stationary vanes and supports the rotor blades 20 so as that the airfoil portion 22 thereof intercepts the flow path of the motive fluid.

Figure 2:
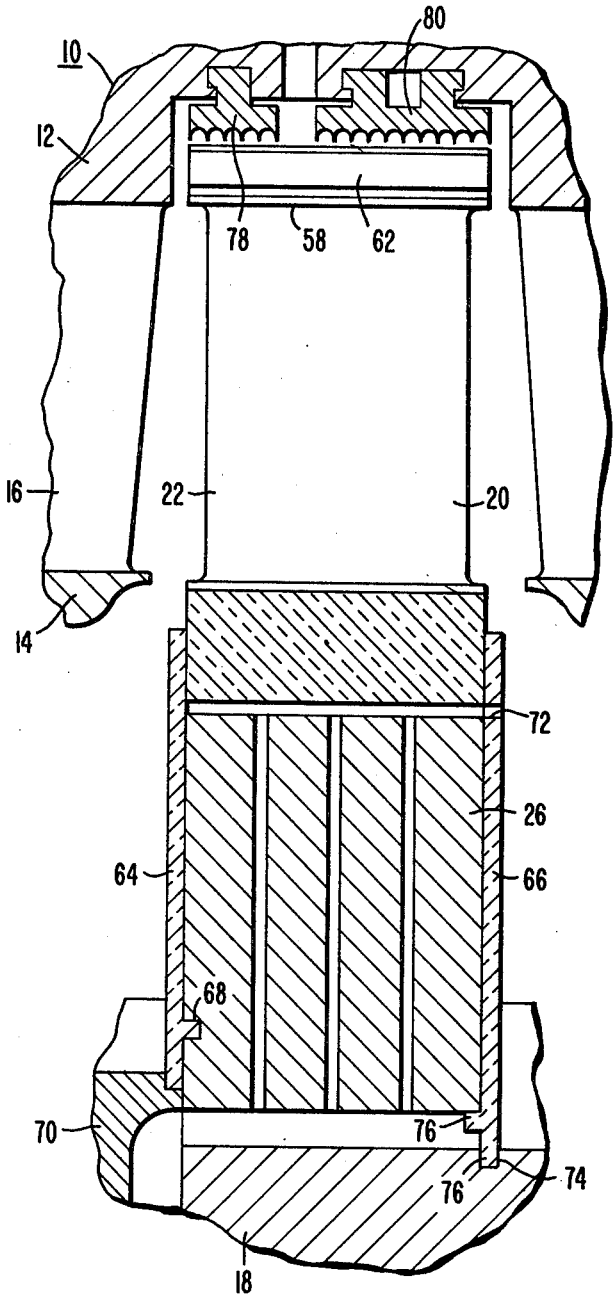

The assembly of the ceramic blades to the rotor disc of the present invention is best shown in FIG. 2 wherein it is seen that the disc 18 defines a plurality of axially extending multiple serration grooves 24 defining a configuration conventionally used for securing blade roots to the rotor disc. Also, as is typical, the rotor and integral disc are composed of a relatively inexpensive ferritic or low alloy metal. Intermediate mounting members 26 have a root portion 28 complimentary to the serrated grooves 24 and are assembled to the disc in the conventional manner. The intermediate members 26 are composed of a high temperature metal alloy of the type generally used for rotor blade material and have a configuration providing a shank portion 30 extending radially from the root portion 28 and terminating at the radially opposite end in an enlarged or "dog-bone" configured end 32 defining upwardly outwardly tapered shoulders 34, thereby defining between any two adjacent intermediate members an undercut groove 36. Platform projections 38 extend from an intermediate position on the shank to terminate adjacent the like platform on the next adjacent member to generally isolate the groove 36 from the rotor disc 18. Also it is seen that a radially extending passage 38 extends through the intermediate members from the root position 28 to the opposite end 32.

The rotor blades 20 of the instant invention are generally composed of a high density ceramic material such as silicon nitride or silicon carbide, having an integrally formed configuration providing an airfoil section 22 which as previously explained, is disposed in the path of the motive fluid, and a root section 40. The root portion 40 describes a radially extending shank 42 terminating at its radially innermost end in a single opposed serration 46 (the shank and enlarged end providing a complimentary "dog-bone" configuration 44 having tapered shoulders 48 complimentary to the tapered shoulders 34 of the intermediate piece to provide a sufficiently large bearing area capable of distributing the centrifugal force resulting from rotation of the blade and bending forces resulting from the motive fluid to provide a stress within the acceptable limits of the brittle ceramic material. Also, such "dog-bone" or single serration configuration is generally devoid of notches as opposed to the conventional multiple serration root design (typified by the rotor disc and intermediate member engagement) that tends to concentrate stress. Also, such tapered engaging surfaces 34, 48 between the intermediate member and the blade root permit unrestrained radial thermal expansion and therefor avoids any stress problems caused by thermal growth.

The airfoil section 22 is separated from the root section 40 by an integral arcuately extending blade platform 50 so that the platforms of adjacent blades extend to adjacent each other to define a generally enclosed cavity radially inwardly thereof. The radially inner surfaces 52 of the platform are gently tapered upwardly outwardly and a ceramic centrifugal force pin 54 is disposed in the cavity and has complimentary surfaces 56 for bearing against the platform in a wedging action under centrifugal force to generally seal the cavity against leakage thereinto of the working fluid and to, in cooperation with all other wedging pins in the annular array, stabilize the blades against low frequency vibration which otherwise could cause the brittle ceramic blades to fail.

The outermost end of the blade 20 terminate in an arcuately extending outer shroud 58 to confine the motive fluid flow path across the airfoil section 22 between the blade platform 50 and the outer shroud 58. Tapered notches 60 are formed in the edge of the outer shroud facing the outer shroud of an adjacent blade and a ceramic centrifugal force pin 62 is disposed in each notch 60 to become wedged under centrifugal force to seal the interface of the adjacent shrouds 58 against escape of the motive fluid, and also assist in fixing the blade against vibration when the wedging engagement is accomplished throughout the annular array of the blade row.

Referring again to FIG. 1 it is seen that the blade root and intermediate members are axially enclosed by seal plates 64, 66 with the upstream seal plate seated in an annular groove 68 and retained by a flow divider wall 70 directing the disc cooling fluid to the root 28 of the intermediate member. The downstream intermediate member has a radially outer opening 72 to permit escape of the cooling fluid from the cavity between adjacent intermediate members, and is axially and radially retained by separate grooves 74 in the disc mating with complimentary projections 76 in the plate. Because the radially outer end of the seal plates are adjacent the flow path of the hot motive fluid it is contemplated that such seal plates will also be composed of a ceramic material. However, because of the limited forces thereon, the tongue and groove retaining means is sufficient to distribute forces to a stress level acceptable to the ceramic physical strength.

It also should be noted that sealing members 78, 80 are disposed between the radially outer surface of the rotating shroud and the housing to prevent leakage of the motive fluid between the shroud and the housing. High pressure cooling fluid is introduced to cool the interface of the shroud and seals. The fluid flows axially upstream and downstream across this interface portion to also increase the sealing effectiveness. It is contemplated that the cooling air will maintain the seals 78, 80 sufficiently cool although they are adjacent the relatively hot ceramic blade.

Thus it is expected, the airfoil portion 22 of the blade will be exposed to working fluid having a temperature of approximately 2300° F which is well above the temperature in which the high temperture alloy can continuously operate. However, the high temperature alloy intermediate piece 26 is protected by the centrifugal force pin seal 54 from exposure to such high temperatures, and the critical area of the intermediate piece 26 engaging the ceramic blade root 46 is cooled by cooling fluid flowing from the cooled rotor disc through the intermediate member to the cavity adjacent the blade root. Such cooling fluid is sufficient to maintain the temperature in this vicinity in the range of 1700° F and thus within the acceptable temperature for the high temperature alloy. Also, the cooling fluid maintains the rotor disc at a temperature of approximately 600° F so that the ferrite alloy is within an acceptable temperature range to maintain its physical strength.

It is felt that an alternative structure wherein the disc and intermediate member would be an integral piece formed of high temperature alloy would be prohibitively expensive. Also, eliminating the intermediate member by extending the shank of the ceramic blade to the rotor would require such large grooves in the rotor over which to distribute the centrifugal force to lessen the stress, that it would unduly limit the number of blades that could be mounted.

Thus, the multiple piece assembly of the present invention provides an economical mounting and securing means for securing ceramic rotor blades in a manner that accommodates the low ductility characteristics of the ceramic material and maintains the metal components within temperature ranges wherein they retain their physical properties.

I claim:

1. A gas turbine rotor and blade assembly for use in a relatively high temperature motive gas stream, said assembly comprising: a ferritic metal disc; an annular array of ceramic blades with each blade having an airfoil portion generally exposed to said high temperature motive gas and a root portion separated therefrom by a blade platform, said platforms in said array providing a generally continuous annular surface to shield said root portion from the hot motive gas; and means interposed between said disc and said blades for mounting said blades to said rotor disc in a radially spaced relationship to minimize exposure of said disc to the high temperature of said blades, said mounting means comprising:

a plurality of intermediate radially extending members attached to said disc, said members comprising a high temperature metal alloy and having a root portion for engagement within a complimentary notch in said disc and an opposite end defining means for engaging and retaining the root portion of said ceramic blades, each member further defining structure disposed in the space separating, and out of contact with, said blade root and said disc to substantially isolate said blade root from said disc and also having radially extending passages providing fluid flow communication between said root of said member and the root portion of said blades for permitting a cooling fluid delivered to said disc to flow through said passages to said blade roots for cooling the respective parts of said assembly and maintaining an acceptable temperature gradient thereacross;

whereby the ferritic metal disc is in a spaced relationship and shielded from structure of said assembly having an elevated temperature and the highest temperature experienced by said disc is less than the lowest temperature on said blade.

2. An assembly according to claim 1 wherein adjacent facing blade platforms define an axially extending cavity and wherein said assembly further includes centrifugal force sealing pins disposed within said cavity, with said cavity and said pins configured such that under centrifugal force said pins sealingly bridge the circumferential gap between adjacent platforms in a wedging engagement to prevent fluid flow therethrough and to dampen low frequency vibration of said blades.

3. An assembly according to claim 2 wherein said centrifugal force sealing pins are composed of a ceramic material.

4. An assembly according to claim 1 wherein each blade terminates in a circumferentially extending shroud portion with facing edges of adjacent shroud portions defining an elongated channel; and, a centrifugal force pin disposed in each such channel to sealingly bridge the circumferential gap between adjacent shroud portions to prevent fluid flow therethrough.

5. An assembly according to claim 4 wherein each centrifugal force pin is composed of a ceramic material.

* * * * *